US011905761B2

(12) United States Patent
Cao et al.

(10) Patent No.: US 11,905,761 B2
(45) Date of Patent: Feb. 20, 2024

(54) ELECTRIC DRILL

(71) Applicant: Globe (Jiangsu) Co., Ltd., Changzhou (CN)

(72) Inventors: Yuexun Cao, Changzhou (CN); Naixin Gao, Changzhou (CN); Lingao Zhang, Changzhou (CN); Tao Wang, Changzhou (CN); Fei Huang, Changzhou (CN)

(73) Assignee: Globe (Jiangsu) Co., Ltd., Changzhou (CN)

( * ) Notice: Subject to any disclaimer, the term of this patent is extended or adjusted under 35 U.S.C. 154(b) by 109 days.

(21) Appl. No.: 17/506,688

(22) Filed: Oct. 21, 2021

(65) Prior Publication Data

US 2022/0127910 A1 Apr. 28, 2022

(30) Foreign Application Priority Data

Oct. 28, 2020 (CN) ..... 202011168552.5

(51) Int. Cl.
*E21B 11/00* (2006.01)
*E21B 3/02* (2006.01)

(52) U.S. Cl.
CPC ..... *E21B 11/005* (2013.01); *E21B 3/02* (2013.01)

(58) Field of Classification Search
CPC ..... E21B 7/005; E21B 7/008; E21B 7/027; E21B 3/02; E21B 3/035; E21B 3/00; E21B 10/44; E21B 11/005; B23B 45/008; B23B 45/02; B25F 5/001; F16D 43/2024; F16D 2125/36; F16D 2127/00; F16D 2127/005; F16D 2066/005
See application file for complete search history.

(56) References Cited

U.S. PATENT DOCUMENTS 2,686,853 A * 8/1954 Mathues ..... H01H 35/142 200/61.49
2,778,468 A * 1/1957 Babaian ..... F16D 43/2024 192/150
2,781,881 A * 2/1957 Sturtevant ..... B25B 23/141 192/56.53
2,975,848 A * 3/1961 Roberts ..... E21B 3/02 408/124

(Continued)

FOREIGN PATENT DOCUMENTS

CN 101013637 A * 8/2007
CN 106639862 B * 7/2019 ..... A01G 23/04

(Continued)

*Primary Examiner* — Jennifer H Gay

(57) ABSTRACT

The disclosure provides an electric drill comprising: a housing; a motor for driving the electric drill to work; an output assembly for outputting the power of the motor; a first brake assembly including a driving disc and a driven disc respectively arranged on the transmission shaft and the output shaft, the driving disc being meshed with the driven disc to transmit power in a non-braking state, and the driving disc and the driven disc being displaced in the axial direction to be separated from each other in a braking state to stop transmitting power; and a second brake assembly including a mass block and a micro switch connected with the motor, and in a braking state, the mass block displacing and triggering the micro switch to stop the motor.

7 Claims, 6 Drawing Sheets

(56) References Cited

U.S. PATENT DOCUMENTS

| | | | | | |
|---|---|---|---|---|---|
| 3,012,441 | A * | 12/1961 | Lamb | E21B 11/005 144/1.1 |
| 3,212,589 | A * | 10/1965 | Wink | E21B 3/035 173/197 |
| 5,531,278 | A * | 7/1996 | Lin | E21B 3/035 173/13 |
| 6,076,617 | A * | 6/2000 | Berner | E21B 7/008 175/18 |
| 2005/0000736 | A1* | 1/2005 | Maki | E21B 10/44 175/394 |
| 2013/0014996 | A1* | 1/2013 | Ruppel | E21B 7/005 175/170 |
| 2014/0174824 | A1* | 6/2014 | Schamberger | H02K 7/145 175/18 |
| 2016/0243692 | A1* | 8/2016 | Patterson | B25F 5/001 |
| 2019/0195019 | A1* | 6/2019 | Wang | E21B 11/005 |
| 2021/0190179 | A1* | 6/2021 | Huang | E21B 10/44 |
| 2022/0120141 | A1* | 4/2022 | Huang | E21B 11/005 |
| 2022/0127910 | A1* | 4/2022 | Cao | E21B 3/035 |

FOREIGN PATENT DOCUMENTS

| | | | | |
|---|---|---|---|---|
| DE | 102011117866 | A1 * | 5/2013 | E21B 11/005 |
| EP | 1469493 | A1 * | 10/2004 | H01C 10/10 |
| EP | 1983146 | A2 * | 10/2008 | E21B 11/005 |
| GB | 2531555 | A * | 4/2016 | E21B 17/06 |
| KR | 20160126796 | A * | 11/2016 | B23B 45/00 |
| WO | WO-2021098417 | A1 * | 5/2021 | B23B 45/02 |

* cited by examiner

ELECTRIC DRILL

CROSS REFERENCE TO RELATED APPLICATION

The present application is related to and claims the benefit of priority of the following Chinese patent applications: serial No. 202011168552.5, filed Oct. 28, 2020; the disclosure of which is hereby incorporated by reference herein in its entirety for all purposes.

TECHNICAL FIELD

The disclosure relates to an electric drill, belonging to the field of electric tools.

BACKGROUND

Electric drill is a tool that drives the drill rod to dig through the ground by a power device. During operation, the drill rod rotates and moves downwards. Under the action of torque and axial force, the soil is cut, and the cut loose soil rises along the working surface of the soil guide. After being transported to the surface, they were thrown away around the pit. The electric drill can adapt to various terrain and soil digging operations, with simple operation, reasonable drilling depth, uniform excavation and high work efficiency.

During the drilling operation, when the blade or vane of the electric drill rod suddenly hits a hard object or is overloaded, the drill rod will suddenly become blocked. If the power transmission of the motor shaft to the drill rod is not immediately cut off at this time, the large torque on the drill rod will cause the machine body to rebound, so that the operator loses the balance of the gravity center and cannot hold the handle of the bracket with both hands, further loses control of the electric drill. Moreover, the large torque easily causes the drill rod to wear or break, which greatly reduces the service life of the machine and affects the progress of the operation.

In view of this, it is indeed necessary to propose an electric drill to solve the above-mentioned problems.

SUMMARY

The disclosure provides an electric drill which allows the user to avoid the hidden security risks caused by the machine's reverse torque when the drill rod is blocked during operation.

The disclosure provides an electric drill, the electric drill comprising:

a housing;

a motor, used for driving the electric drill to work;

an output assembly, used for outputting power of the motor, including: a transmission shaft, and an output shaft, wherein the transmission shaft and the output shaft are arranged in parallel, and the transmission shaft is connected with the motor and outputs the power through the output shaft;

a first brake assembly, including:

a driving disc, and a driven disc, wherein the driving disc and the driven disc are respectively arranged on the transmission shaft and the output shaft, the driving disc is engaged with the driven disc to transmit power in a non-braking state, and the driving disc and the driven disc are displaced in the axial direction to be separated from each other in a braking state to stop transmitting power; and a second brake assembly, including:

a mass block, and a micro switch connected with the motor, wherein in the braking state, the mass block displaces and triggers the micro switch to stop the motor.

As a further improvement of the disclosure, one of the driving disc and the driven disc is provided with a boss, the other is provided with a groove matching the boss, and the boss and the groove are respectively provided with an inclined surface.

As a further improvement of the disclosure, a first rolling element is provided between the driving disc and the transmission shaft, and a second rolling element is provided between the driven disc and the output shaft.

As a further improvement of the disclosure, an inner side of the driving disc and an outer wall of the transmission shaft are both provided with a first accommodating groove matched with the first rolling element, and the first accommodating groove extends along the axial direction of the transmission shaft to limit the rotation of the driving disc relative to the transmission shaft; and an inner side of the driven disc and an outer wall of the output shaft are both provided with a second accommodating groove matched with the second rolling element, and the second accommodating groove extends along the axial direction of the output shaft to limit the rotation of the driven disc relative to the output shaft.

As a further improvement of the disclosure, a first elastic element sleeved on the transmission shaft is arranged above the driving disc and used for resetting the driving disc after displacement, an upper bearing sleeved on the transmission shaft is arranged at an upper end of the first elastic element, and a lower bearing sleeved on the output shaft is arranged at a lower end of the driven disc.

As a further improvement of the disclosure, the second brake assembly includes a second elastic element arranged between the micro switch and the mass block.

As a further improvement of the disclosure, the second brake assembly includes a brake box for accommodating the micro switch, the second elastic element and the mass.

As a further improvement of the disclosure, the mass block is horizontally arranged in the brake box, so that the mass block is displaced in a horizontal direction, and the brake box is arranged in the housing.

As a further improvement of the disclosure, the electric drill further includes a bracket fixed on the outside of the housing, the bracket includes a handle, and a switch for starting the motor is provided on the handle.

As a further improvement of the disclosure, the electric drill further includes a battery pack assembly for supplying power to the motor, and the battery pack assembly at least partially protrudes outside the housing.

The beneficial effects of the disclosure are that: the electric drill comprises a first brake assembly and a second brake assembly, the first brake assembly is a mechanical clutch device and stops transmitting power in a braking state; the second brake assembly starts the electronic switch to stop the motor under the action of inertia force; the first brake assembly and the second brake assembly operate independently. Due to the arrangement, the reliability of the mechanical braking mechanism can be kept, meanwhile, the quick response of electronic braking is achieved, the potential safety hazard caused by the counter torque of the machine when the drill rod is blocked is avoided through double protection, and the drill rod is simple and reliable in structure and convenient to install.

DETAILED DESCRIPTION

In order to make the objectives, technical solutions and advantages of the disclosure clearer, the disclosure will be described in detail below with reference to the accompanying drawings and specific embodiment.

Figure 1:
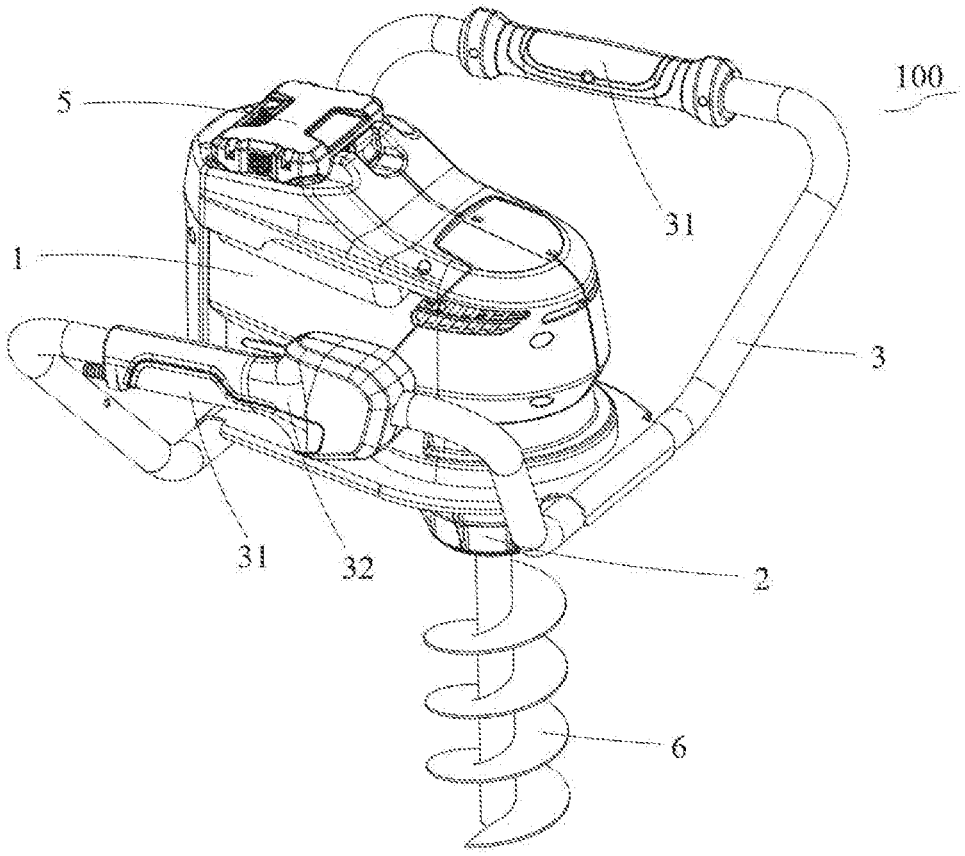
FIG. 1 is a schematic view showing an overall structure of an electric drill.
Figure 2:
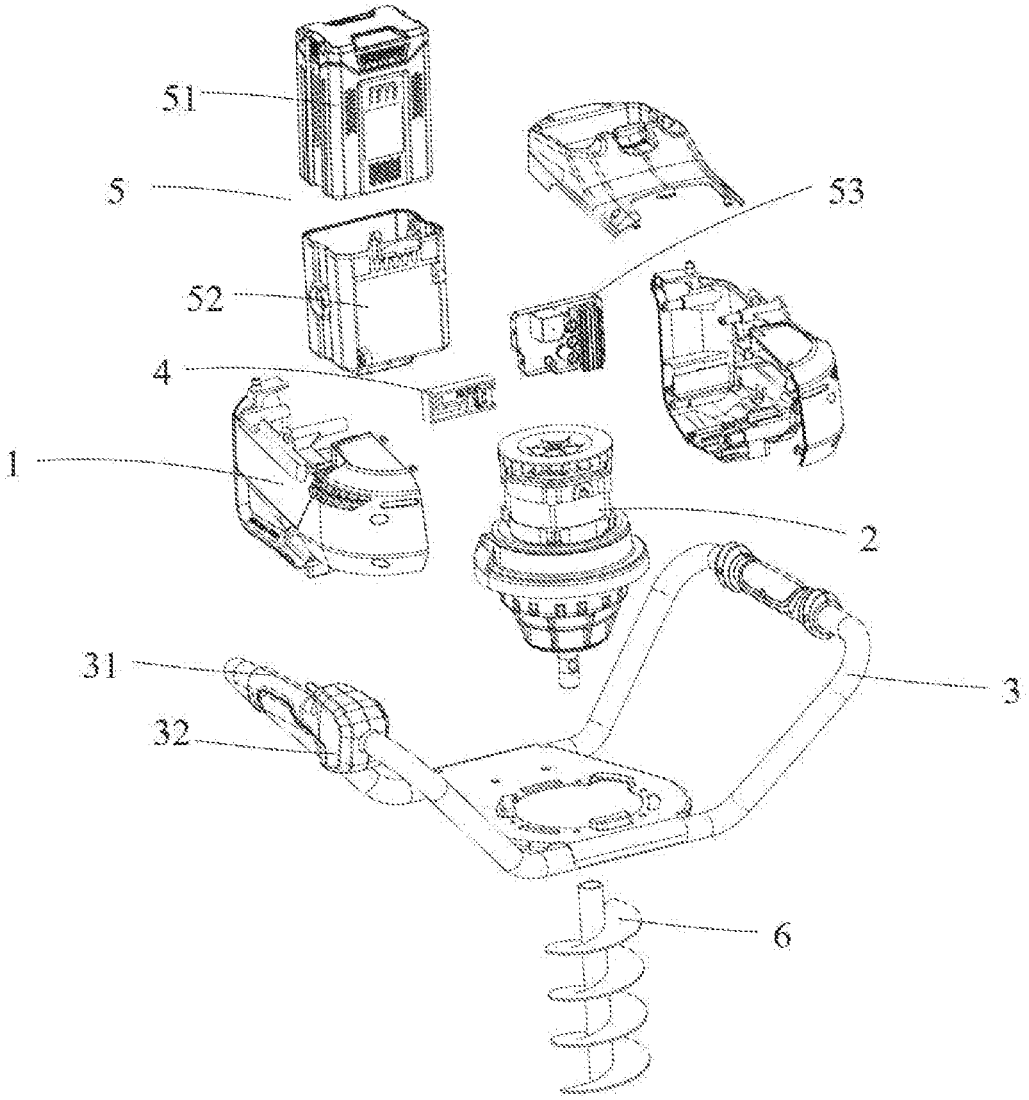
FIG. 2 is a schematic view showing an explosion structure of an electric drill.

As shown in FIGS. 1 and 2, the disclosure shows an electric drill 100 which comprises a housing 1, a power assembly 2, a bracket 3, a second brake assembly 4, a battery pack assembly 5 and a drill rod 6. The bracket 3 is fixed on the outer side of the housing 1. The power assembly 2, the second brake assembly 4 and the battery pack assembly 5 are contained in the housing 1. The drill rod 6 is connected with the power assembly 2, and the power assembly 2 is used for outputting power to drive the drill rod 6 to operate.

Figure 3:
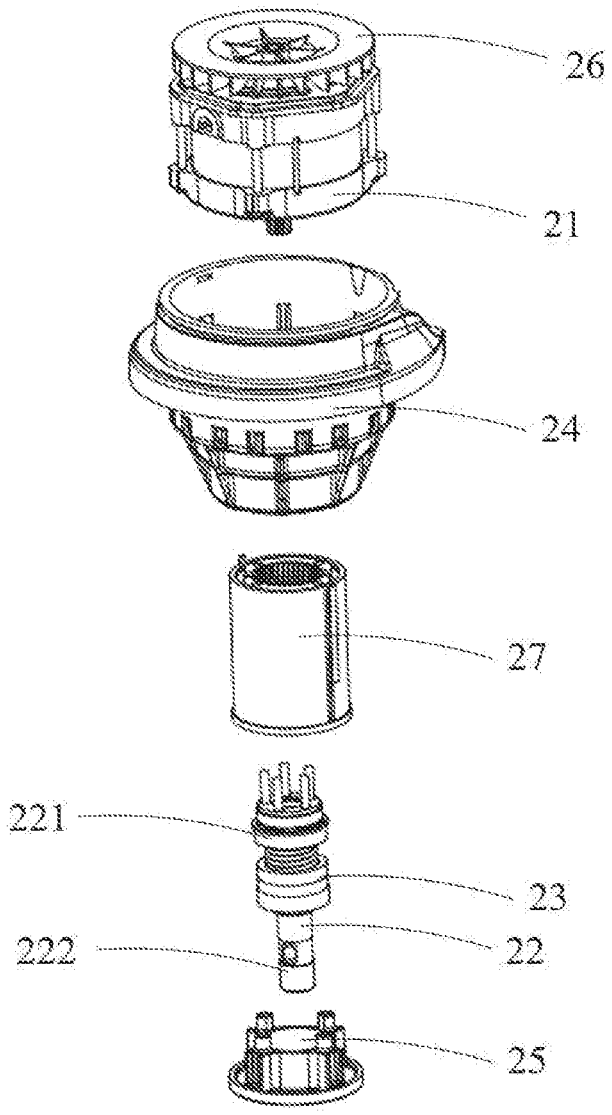
FIG. 3 is a schematic view of a power assembly of an electric drill.

As shown in FIG. 3, the power assembly 2 comprises a motor 21, an output assembly 22, a first brake assembly 23, a motor seat 24 and a fixed seat 25. The fixed seat 25 is used for mounting the motor 21, the output assembly 22 and the first brake assembly 23 in the motor seat 24. The output assembly 22 comprises a transmission shaft 221 and an output shaft 222, the transmission shaft 221 and the output shaft 222 are arranged in parallel and arranged up and down in sequence. And the motor 21 is connected with the transmission shaft 221 through the motor shaft, and outputs power through the output shaft 222.

The power assembly 2 further comprises a fan 26 arranged at one end in the axial direction of the motor 21 and used for radiating heat to the motor 21, the fan 26 is connected with the motor shaft, and the motor 21 simultaneously drives the fan 26 to work during operation. The fan 26 may be a centrifugal fan or an axial fan.

The power assembly 2 further includes a gear box 27 disposed between the motor 21 and the output assembly 22 for reducing the rotating speed output by the motor 21 and increasing the rotational torque.

Figure 4:
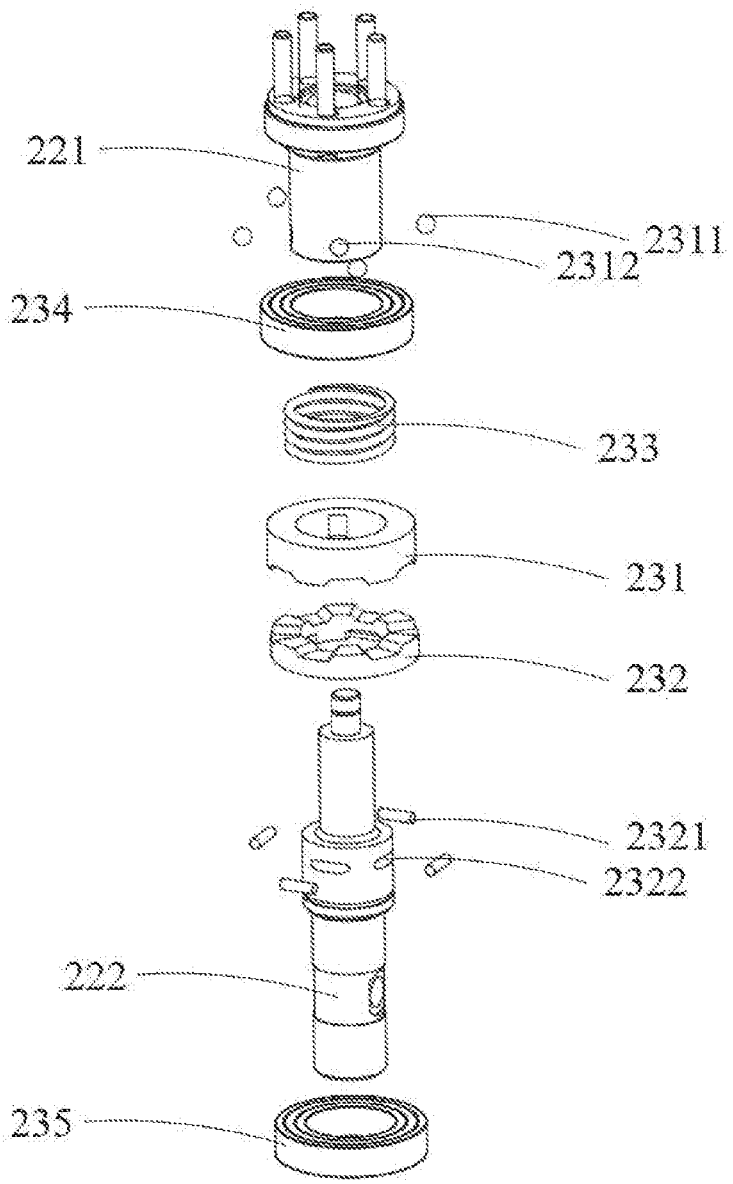
FIG. 4 is a schematic view of the structure of an output assembly and a first brake assembly of an electric drill.
Figure 5:
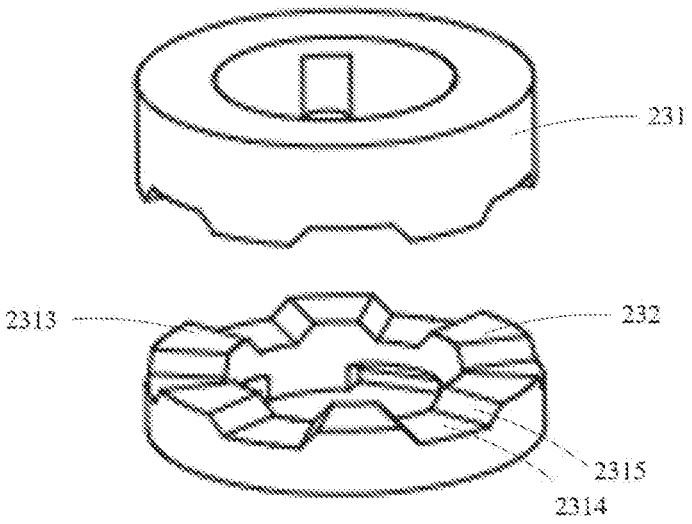
FIG. 5 is a schematic view showing the structure of a driving disc and a driven disc of an electric drill.
Figure 6:
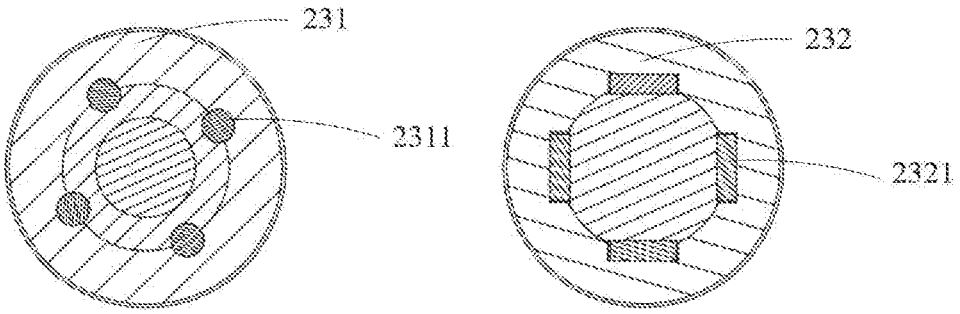
FIG. 6 is a top cross-sectional view of a driving disc and a driven disc of an electric drill.

As shown in FIGS. 4 to 6, the first brake assembly 23 includes a driving disc 231 and a driven disc 232 respectively provided on the transmission shaft 221 and the output shaft 222, and in a non-braking state, the driving disc 231 and the driven disc 232 are engaged up and down to transmit power; in the braking state, the driving disc and the driven disc are displaced in the axial direction to be separated from each other to stop power transmission. A first rolling element 2311 is provided between the driving disc 231 and the transmission shaft 221, and a second rolling element 2321 is provided between the driven disc 232 and the output shaft 222, such that a displacement of the driving disc 231 and the driven disc 232 generates in the axial directions of the transmission shaft 221 and the output shaft 222 respectively, so that the electric drill 100 is subjected to axial pressure in operation to press the driving disc 231 and the driven disc 232 against each other.

The inner side of the driving disc 231 and the outer wall of the transmission shaft 221 are provided with a first accommodating groove 2312 matched with the first rolling element 2311, and the number of the first rolling element 2311 is one or more. The inner side of the driven disc 232 and the outer wall of the output shaft 222 are provided with a second accommodating groove 2322 matched with the second rolling element 2321, and the number of the second rolling element 2321 is one or more. The first rolling element 2311 serves to define rotation of the driving disc 231 on the transmission shaft 221, and the second rolling element 2321 serves to define rotation of the driven disc 232 on the output shaft 222.

In an embodiment of the disclosure, the first rolling element 2311 may be a rolling ball, and the second rolling element 2321 may be a needle roller disposed horizontally and transversely. Preferably, the numbers of the first rolling element 2311 and the second rolling element 2321 are both set to four. Of course, the first rolling element 2311 and the second rolling element 2321 may be of other structures and numbers, which are not limited thereto.

And a first elastic element 233 sleeved on the transmission shaft 221 is arranged above the driving disc 231 and used for resetting the driving disc 231 after displacement of the driving disc 231. The upper end of the first elastic element 233 is provided with an upper bearing 234 sleeved on the transmission shaft 221, and the lower end of the driven disc 232 is provided with a lower bearing 235 sleeved on the output shaft 222.

One of the driving disc 231 and the driven disc 232 is provided with a boss 2313, the other of the driving disc 231 and the driven disc 232 is provided with a groove 2314 matched with the boss 2313, and the boss 2313 and the groove 2314 are respectively provided with an inclined surface 2315 capable of enabling the boss 2313 to slide out of the groove 2314. The role of the inclined surface 2315 is that the driving disc 231 and the driven disc 232 can be separated through the inclined surface 2315 in a braking state when the electric drill 100 is about to be blocked, so as to achieve a safe braking effect.

Figure 7:
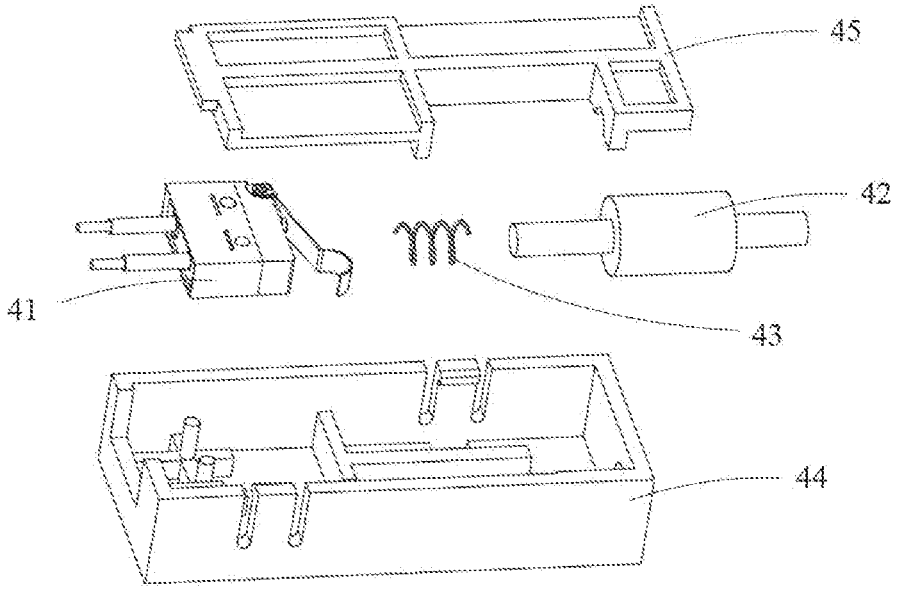
FIG. 7 is a schematic view of a second brake assembly of an electric drill.

As shown in FIG. 7, the second brake assembly 4 includes a micro switch 41, a mass block 42, a second elastic element 43, and a brake box 44. The micro switch 41 is connected to the motor 21 for sending a stop signal to the motor 21. The mass block 42 is used for triggering the micro switch 41, and when the electric drill 100 is subjected to reaction torque in an accident situation, the mass block 42 moves a displacement in the horizontal direction due to inertia and triggers the micro switch 41, and the second brake assembly 4 is in a braking state. A second elastic element 43 is provided between the micro switch 41 and the mass block 42 for preventing the mass block 42 from triggering the micro switch 41 in the non-braking state. The micro switch 41, the second elastic element 43, and the mass block 42 are horizontally disposed in the brake box 44, wherein the mass block 42 is horizontally disposed so that the mass block 42 is displaced in the horizontal direction. The brake box 44 is further provided with a cover plate 45, the brake box 44 being arranged in the housing 1.

Figure 8:
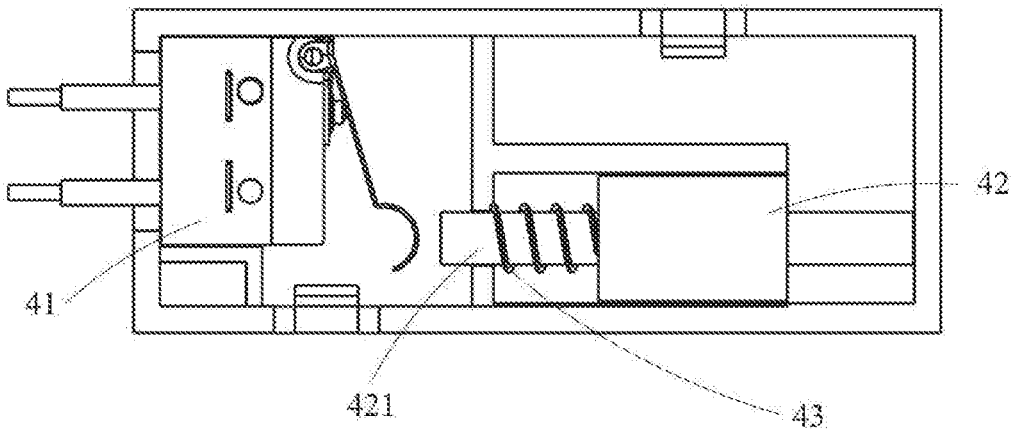
FIG. 8 is a cross-sectional view of a second brake assembly of an electric drill.

As shown in FIG. 8, a sliding groove (not numbered) for the mass block 42 to slide is arranged in the brake box 44. One end of the mass block 42 facing the micro switch 41 is provided with a protruding part 421, the other end of the mass block 42 abuts against the brake box 44. The second elastic element 43 is sleeved on the protruding part 421 and abuts against the top of the sliding groove, and the protruding part 421 extends to the area of the micro switch 41 through an opening (not numbered) at the top of the sliding groove, and a certain distance is kept between the protruding part 421 and the triggering structure of the micro switch 41, so that the mass block 42 can smoothly trigger the micro switch 41.

In normal operation, the direction of displacement of the mass block 42 coincides with the direction of rotation of the drill rod 6 of the electric drill 100 during operation. Due to unexpected circumstances, such as when the drill rod 6 suddenly hits a hard object or the load is too large, the electric drill 100 is affected by the reaction torque, then the housing 1 is reversed with respect to an operator, such that the mass block 42 in the second brake assembly 4 is subjected to an inertial force. When the inertial force is greater than the force exerted on the mass block 42 by the second elastic element 43, the mass block 42 is displaced along the horizontal direction to trigger the micro switch 41 to send a stop signal to the motor 21 to stop the electric drill 100.

The bracket 3 is symmetrical to the left and right about the axis of the driving shaft, both sides of the bracket 3 are provided with handles 31 for holding, one of the handles 31 is provided with a switch assembly for starting the motor 21. The switch assembly comprises a starting switch 32 and a reversing switch (not shown), and the reversing switch is used for controlling the motor 21 to reversely rotate so as to reversely rotate the drill rod 6.

As shown in FIGS. 1 and 2, the electric drill 100 is provided with a battery pack assembly 5 for supplying power to the motor 21, the battery pack assembly 5 partially protruding outside the housing 1 to facilitate heat dissipation, the battery pack assembly 5 including one or more battery packs 51 and a battery tub 52 for receiving the battery packs, wherein any combination of series connection and parallel connection between the plurality of battery packs 51 is possible. When a plurality of battery packs 51 are provided, the battery tub 52 may be provided with a separator to separate the battery packs 51 for installation. The battery pack 51 may be non-detachably mounted in the battery tub 52 or may be detachably mounted in the battery tub 52. Preferably, when the battery pack 51 is detachably mounted in the battery tub 52, the insertion direction in which the battery pack 51 is inserted into the battery tub 52 is substantially parallel to the rotation axis of the drive shaft, so that when the battery pack 51 is inserted, the force applied by the user can be effectively reduced, and the volume of the housing 1 can be made compact.

The electric drill 100 further includes a circuit board 53. The circuit board 53 is electrically connected to the battery pack assembly 5, the motor 21, the switch assembly, and the second brake assembly 4 for controlling the start, stop and rotation, such as rotation speed and steering, of the motor 21. In this embodiment, the circuit board 53 and the second brake assembly 4 are provided at one side of the battery tub 52 to facilitate the arrangement of the connection wires. Specifically, fixing grooves are provided in the housing 1 to mount the circuit board 53 and the second brake assembly 4, respectively. It should be noted that the circuit board 53 and the second brake assembly 4 may also be provided in other fixing manners.

The operational flow of the electric drill 100 will be described in detail below.

During normal operation of the electric drill 100, the drill rod 6 is inserted into the ground, then the switch 32 is turned on to start the motor 21, the transmission shaft 221 transmits power to the driving disc 231 after being decelerated by the gear box 27. The driving disc 231 and the driven disc 232 are embedded and mutually compressed in a staggered mode due to the thrust of the first elastic element 233, such that the driving disc 231 transmits power to the driven disc 232, and then the driven disc 232 transmits power to the output shaft 222; thereby the output shaft 222 drives the drill rod 6 to operate. At this time, the operator holds the handle 31 on the bracket 3, and the drilling operation can be carried out by lightly applying downward pressure.

When the drill rod 6 suddenly hits a hard object or a load is too large to stop rotating, the meshing parts of the driving disc 231 and the driven disc 232 relatively rotate, the first elastic element 233 is compressed by the axial component force to enable the driving disc 231 to move upwards and slide with the driven disc 232. At this time, the transmission shaft 221 idles, and the first brake assembly 23 is in a braking state. When the load returns to normal, the driving disc 231 is engaged with the driven disc 232 by the elastic force of the first elastic element 233 to retransmit the torque, so as to protect the electric drill 100 from damage.

When the electric drill 100 is subjected to reverse torque, the whole electric drill 100 reverses rotation relative to an operator, the second brake assembly 4 is in a braking state, the mass block 42 in the second brake assembly 4 generates relatively large movement under the action of inertia and triggers the micro switch 41. The micro switch 41 sends a signal to instruct the motor 21 to brake, so that the electric drill 100 stops running, and at the moment, the electric drill 100 can be pulled upwards appropriately or drill rod 6 can be reversely rotated by a start of the reversing switch to eliminate the obstruction, normal drilling operations may then continue.

In summary, the structure of the disclosure is simple and convenient to install, and through double protection of the first brake assembly 23 and the second brake assembly 4, the accidental situation caused by the reverse torque of the machine when the drill rod 6 is blocked is avoided.

The above embodiments are only used to illustrate the technical solutions of the disclosure and not to limit them. Although the disclosure has been described in detail with reference to the preferred embodiments, those of ordinary skill in the art should understand that the technical solutions of the disclosure can be modified or equivalently replaced. Without departing from the spirit and scope of the technical solution of the disclosure.

What is claimed is:

1. An electric drill, comprising:

a housing;

a motor, used for driving the electric drill to work;

an output assembly, used for outputting power of the motor, including:

a transmission shaft, and an output shaft, wherein the transmission shaft and the output shaft are arranged in parallel, and the transmission shaft is connected with the motor and outputs the power through the output shaft;

a first brake assembly, including:

a driving disc, and a driven disc, wherein the driving disc and the driven disc are respectively arranged on the transmission shaft and the output shaft, the driving disc is engaged with the driven disc to transmit power in a non-braking state, and the driving disc and the driven disc are displaced in the axial direction to be separated from each other in a braking state to stop transmitting power; and a second brake assembly, including:

a mass block, a micro switch connected with the motor, wherein in the braking state, the mass block displaces and triggers the micro switch to stop the motor, an elastic element of the second brake assembly disposed between the micro switch and the mass block, and a brake box for receiving the micro switch, the elastic element of the second brake assembly, and the mass, wherein the mass block is horizontally disposed in the brake box such that the displacement of the mass block is in a horizontal direction, and the brake box is disposed in the housing.

2. The electric drill of claim 1, wherein one of the driving disc and the driven disc is provided with a boss, the other is provided with a groove matched with the boss, and the boss and the groove are respectively provided with an inclined plane.

3. The electric drill of claim 1, wherein a first rolling element is arranged between the driving disc and the transmission shaft, and a second rolling element is arranged between the driven disc and the output shaft.

4. The electric drill of claim 3, wherein an inner side of the driving disc and an outer wall of the transmission shaft are both provided with a first accommodating groove matched with the first rolling element, the first accommodating groove extending along an axial direction of the transmission shaft to limit a rotation of the driving disc relative to the transmission shaft, and an inner side of the driven disc and the outer wall of the output shaft are both provided with a second accommodating groove matched with the second rolling element, the second accommodating groove extending along an axial direction of the output shaft to limit a rotation of the driven disc relative to the output shaft.

5. The electric drill of claim 1, wherein a elastic element of the first brake assembly sleeved on the transmission shaft is arranged above the driving disc and used for resetting the driving disc after displacement, an upper bearing sleeved on the transmission shaft is arranged at an upper end of the elastic element of the first brake assembly, and a lower bearing sleeved on the output shaft is arranged at a lower end of the driven disc.

6. The electric drill of claim 1, further comprising:

a bracket fixed on an outer side of the housing, the bracket including a handle mounted with a switch used for starting the motor.

7. The electric drill of claim 1, further comprising:

a battery pack assembly for supplying power to the motor, the battery pack assembly at least partially protruding out of the housing.

* * * * *